United States Patent [19]

Marco

[11] 4,170,557

[45] Oct. 9, 1979

[54] PROCESS AND COMPOSITION FOR IMPARTING ANTI-SOIL REDEPOSITION AND SOIL RELEASE PROPERTIES TO POLYESTER TEXTILE MATERIALS

[75] Inventor: Francis W. Marco, Pauline, S.C.

[73] Assignee: Milliken Research Corporation, Spartanburg, S.C.

[21] Appl. No.: 895,165

[22] Filed: Apr. 11, 1978

[51] Int. Cl.[2] ..... D06M 13/10

[52] U.S. Cl. ..... 252/8.6; 8/115.6

[58] Field of Search ..... 252/8.6, DIG. 15; 8/115.6

[56] References Cited

U.S. PATENT DOCUMENTS

| | | | |
|---|---|---|---|
| 2,876,140 | 3/1959 | Sheehan | 252/8.6 UX |
| 2,979,373 | 4/1961 | Seegrist | 252/8.6 |
| 3,523,088 | 4/1970 | Dean et al. | 252/DIG. 15 |
| 3,782,898 | 1/1974 | Mandell | 252/DIG. 2 |
| 3,904,359 | 9/1975 | Ramachandran | 252/8.6 |
| 3,912,681 | 10/1975 | Dickson | 8/115.6 |

*Primary Examiner*—William E. Schulz

*Attorney, Agent, or Firm*—H. William Petry

[57] ABSTRACT

An aqueous fabric treating composition for improving the particulate redeposition properties, as well as the soil release properties, of a polyester textile material during a laundering process is provided in which the aqueous fabric treating composition contains, as essential ingredients, from about 0.0001 to about 10 weight percent of a cellulose ether soil release agent and an effective amount of an anti-redeposition agent selected from the group consisting of citric acid and acidic acrylic copolymers containing from about 10 weight percent to about 90 weight percent of the acid constituent, such being calculated as acrylic acid. The effective amount of the anti-redeposition agent is that amount sufficient to provide a ratio of the anti-redeposition agent to the cellulose ether soil release agent of from about 1.5:1 to about 10:1. A method for improving the particulate redeposition properties of polyester textile materials during the laundering process, while providing desirable soil release properties to such materials, as well as the products so produced, is also provided.

9 Claims, No Drawings

PROCESS AND COMPOSITION FOR IMPARTING ANTI-SOIL REDEPOSITION AND SOIL RELEASE PROPERTIES TO POLYESTER TEXTILE MATERIALS

This invention relates to textile materials formed of polyester fibers having durable soil release and particulate redeposition properties. In one aspect it relates to an aqueous fabric treating composition which, when applied to polyester textile materials, provides improved particulate redeposition properties and soil release properties to such textile material. In yet another aspect this invention relates to polyester textile materials having improved particulate redeposition properties, as well as soil release properties, and to methods for treating polyester textile materials to impart such properties thereto.

The genesis of synthetically produced textile fibers, such as polyester fibers, has brought about a tremendous effort in the textile industry along numerous avenues. There has been much research effort directed to the improvement of synthetic fibers, especially the polyester fibers, to improve the soil release characteristics of textile materials produced from such fibers. A major concern has been the difficulty of cleaning garments made from polyester fibers using conventional home washing procedures due to the oleophilic nature of the garments made from the textile materials of polyester fibers. Numerous efforts have been proposed to alter such oleophilic properties of the textile materials containing polyester fibers so that the dirt and/or oily deposits on the soiled clothes can be readily removed by home washing procedures. Many polymeric systems have been proposed, including the use of a cellulose ether soil release agent, in an effort to provide the desired soil release characteristics to the textile materials. Numerous other polymeric systems, such as acid emulsion polymers prepared from organic acids having reactive points of unsaturation have likewise been applied to textile materials formed of polyester fibers in an effort to improve the soil release properties of such materials. While these and other soil release agents have provided improved soil release characteristics to the textile materials formed of polyester fibers, problems have, nevertheless, been encountered in that many times while the desired soil release characteristics are obtained, a problem has evolved relating to the redeposition of particulate matter present in the wash water upon the textile materials formed of polyester fibers. Thus, new and improved compositions have long been sought which would provide the textile materials formed of polyester fibers with durable soil release characteristics while, at the same time, reducing or substantially eliminating the undesirable particulate redeposition properties so prevalent when a polyester textile material is treated so as to render same soil resistant. This is further borne out by the fact that untreated polyester textile materials encounter little or no redeposition of particulate soil during the home laundering process but, at the same time, due to their oleophilic nature, retain oily stains present on such textile materials during the laundering process. On the other hand, when properly treated with a soil release agent or additive, the oily stains present on such material can substantially be removed during the washing process but a serious problem of particulate redeposition then occurs. Numerous attempts have been made heretofore to provide improved compositions which, upon application to a polyester textile material, would allow one to obtain the desired soil release characteristics while at the same time prevent or substantially reduce the redeposition of particulate matter on such materials during the washing process.

Accordingly, by virtues of the teachings of the present invention, problems historically present with the use of garments produced from textile materials of polyester are substantially eliminated or reduced in that such materials not only contain the desired durable soil release characteristics imparted to such materials, but also possess improved anti-redeposition characteristics.

It is therefore an object of the present invention to provide a textile material formed of polyester fibers having durable soil release and improved anti-redeposition characteristics. It is another object of the present invention to provide a process for imparting durable soil release and anti-redeposition properties to textile materials formed of polyester fibers. These and other objects, advantages, and features of the present invention will be apparent to those skilled in the art from a reading of the following detailed description.

Generally speaking, the present invention is directed to textile materials formed of polyester fibers having durable soil release characteristics, improved anti-soil redeposition characteristics when garments produced from such textile materials are subjected to a laundering process, and to a process for producing same. Further, the present invention is directed to an aqueous fabric treating composition which imparts the desired soil release characteristics and anti-redeposition characteristics to such textile materials. Broadly, such is achieved by applying to a textile material formed of polyester fibers an effective amount of an aqueous fabric treating composition containing, as essential ingredients, from about 0.0001 to about 10 weight percent of a cellulose ether soil release agent and an effective amount of an anti-redeposition agent selected from the group consisting of citric acid and acrylic acid copolymers wherein such acrylic copolymers contain from about 10 to about 90 weight percent of the acid constituent, such being calculated as acrylic acid. The effective amount of the anti-redeposition agent employed in the aqueous fabric treating composition can vary widely but will generally be present in an amount sufficient to provide a ratio of the anti-redeposition agent to the cellulose ether soil release agent of from about 1.5:1 to about 10:1. Especially desirable results can be obtained when the ratio of the anti-redeposition agent to the cellulose ether soil release agent is from about 2:1 to about 5:1.

It is believed that the cellulose ether soil release agent present in the aqueous fabric treating composition imparts the desired soil release characteristics to the textile material formed of the polyester fibers. However, it should be noted that the use of such cellulose ether soil release agents by themselves do not provide the desired anti-redeposition properties to such textile materials. Thus, it is believed that any suitable cellulose ether soil release agent can be employed in the aqueous fabric treating composition of the present invention for improving the soil release properties of the polyester textile material. Typical of such cellulose ether soil release agents are methyl cellulose, hydroxy butyl methyl cellulose, hydroxy propyl methyl cellulose, hydroxy propyl cellulose, and the like.

As previously stated, I have found that in order to provide the desired anti-redeposition properties to the textile materials formed of polyester fibers one must incorporate into the aqueous fabric treating composition, in addition to the cellulose ether soil release agent, an effective amount of an anti-redeposition agent selected from the group consisting of citric acid and acrylic acid copolymers wherein such copolymers contain from about 10 weight percent to about 90 weight percent of the acid constituent, such being calculated as acrylic acid. The amount of the above specified anti-redeposition agent which can be employed in the aqueous fabric treating composition in combination with the cellulose ether soil release agent can vary widely but is generally present in an amount so as to provide a ratio of the particulate anti-redeposition agent to the cellulose ether soil release agent of from about 1.5:1 to about 10:1. While any suitable acidic acrylic copolymers meeting the above definition can be employed, especially desirable results can be obtained when the acidic acrylic copolymer anti-redeposition agent is a copolymer of ethyl acrylate and methacrylic acid and the ethyl acrylate and methacrylic acid constituents are present in a ratio of about 30:70 percent respectively.

The amount of the aqueous fabric treating composition applied to the polyester textile material can vary widely, such being determined to a large extent upon the make up of the treating composition as well as the wet-pickup properties of the textile material. Generally, however, it is desirable that a sufficient amount of the aqueous fabric treating composition be employed so that at least about 0.0001 weight percent of the hydroxy ether cellulose soil release agent be present on the textile material and at least about 0.001 weight percent of the anti-redeposition agent likewise be present on the textile material. However, especially desirable results can be obtained when the amount of the hydroxy ether cellulose constituent is present on the material in an amount of from about 0.01 to about 10 weight percent and the amount of the anti-redeposition agent is likewise present on the textile material in an amount of from about 0.015 to about 10 percent. While the exact mechanism occuring between the cellulose ether soil release agent, the anti-redeposition agent, and the textile material formed of polyester fibers is not completely understood, it is apparent, as will be borne out by the examples hereinafter, that a product results which does in fact provide such textile material with durable soil release characteristics and improved anti-redeposition characteristics.

The application of the aqueous treating composition above described to the textile material containing polyester fibers can be by any suitable method, such as padding, exhaustion, spraying and the like. However, especially desirable results can be obtained when the aqueous fabric treating composition is applied to the textile material using a padding technique. When applying the aqueous fabric treating composition to the polyester textile material, the material is contacted or padded with the liquid admixture so as to provide a resulting wet textile material containing the before-described amounts of the cellulose ether soil release agent and anti-redeposition agent. Thereafter, the resulting wetted textile material containing the desired amount of the cellulose ether soil release agent and anti-redeposition agent is dried using any conventional drying technique such as air drying or passing the wet textile material through an oven for a period of time effectively to remove substantially all of the water and provide a dried textile material containing the before-mentioned amounts of cellulose ether soil release agent and anti-redeposition agent. As previously stated, any suitable drying technique can be employed, the only requirement being that one must exercise care to insure that the temperature at which the wetted textile material is dried does not exceed the decomposition temperature of either the cellulose ether soil release agent or the anti-redeposition agent or the polyester fibers of which the textile materials is made. Generally, such drying of the wetted fabric can be accomplished by passing the textile material through a drying oven which has been heated to a temperature of from about 110° C. to about 180° C. for a period of time effective to remove substantially all of the water from the textile material. Once the aqueous fabric treating composition has been applied to the textile material so as to provide the desired amounts of the cellulose ether soil release agent and the anti-redeposition agent to the textile material, and substantially all of the water has been removed, further processing steps which are well known in the textile industry can be employed if desired, such as heat setting, curing, and the like.

In order to further illustrate the concept of the subject invention the following example is given. However, it is to be understood that such example is given for illustrative purposes only and is not to be construed as unduly limiting the subject invention as set forth hereafter in the claims. In the example, unless otherwise stated, all parts and percentages are parts and percentages by weight.

EXAMPLE

A series of experiments were conducted in which a plurality of pad baths were prepared, each of such pad baths containing 0.1 percent of a soil release agent, hydroxy butyl methyl cellulose and varying amounts and types of proposed anti-redeposition agents. Each of the pad baths were padded onto samples of 100 percent textured polyester double knit fabric to about 100 percent wet pickup. The padded fabric samples were then dried and cured in a single operation by placing such samples in an oven heated to 175° C. for 5 minutes. Thereafter, a portion of each of the dried samples was tested for anti-redeposition properties and another portion of each sample was evaluated for soil release of mineral oil and used crankcase motor oil.

In conducting the evaluation of the samples for anti-redeposition the following procedure was employed.

One-half gram sample swatches of each of the fabric samples were placed together in a test solution and shaken in the test solution for five minutes. Thereafter, the swatches were removed from the test solutions, rinsed two times with tap water, air dried, and visually evaluated. The test solutions were each a 500 ml aqueous solution containing 0.2 weight percent of a commercial household detergent and 0.5 weight percent of finely dispersed carbon black. The results of such tests and evaluations as to anti-redeposition are set forth in Table I.

Table I

| Sample No. | Soil Release Agent (%) | Anti-Redeposition Agent (%) | Anti-Redeposition Agent | Results |
|---|---|---|---|---|
| 1 | 0.1 | 0.005 | Citric Acid | Substantial Carbon Black Redoposition |
| 2 | 0.1 | 0.05 | Citric Acid | Substantial |

Table I-continued

| Sample No. | Soil Release Agent (%) | Anti-Redeposition Agent (%) | Anti-Redeposition Agent | Results |
|---|---|---|---|---|
| | | | | Carbon Black Redeposition |
| 3 | 0.1 | 0.2 | Citric Acid | Minor Carbon Black Redeposition |
| 4 | 0.1 | 0.5 | Citric Acid | Substantially No Carbon Black Redeposition |
| 5 | 0.1 | 0.15 | Acidic Acrylic Copolymer* | Substantially No Carbon Black Redeposition |
| 6 | 0.1 | 0.1 | Boric Acid | Substantial Carbon Black Redeposition |
| 7 | 0.1 | 0.5 | Boric Acid | Substantial Carbon Black Redeposition |
| 8 | 0.1 | 0.1 | Malic Acid | Substantial Carbon Black Redeposition |
| 9 | 0.1 | 0.5 | Malic Acid | Substantial No Carbon Black Redeposition |
| 10 | 0.1 | 0.1 | Polyacrylic Acid | Substantial Carbon Black Redeposition |
| 11 | 0.1 | 0.5 | Polyacrylic Acid | Improved Over No. 10 But Still Considerable Carbon Black Redeposition |
| 12 | 0.1 | 0.1 | Itaconic Acid | Substantial Carbon Black Redeposition |
| 13 | 0.1 | 0.5 | Itaconic Acid | Substantial Carbon Black Redeposition |
| 14 | 0.1 | 0.5 | Tartaric Acid | No Carbon Black Redeposition |
| 15 (Control) | 0.1 | 0 | | Substantial Carbon Black Redeposition |
| 16 (Control) | 0 | 0 | | No Carbon Black Redeposition |

*Copolymer of 30% ethyl acrylate and 70% methacrylic acid.

In conducting the evaluation of the samples for soil release a portion of each of the dried padded fabrics was tested as follows:

A portion of each sample was stained prior to washing with mineral oil and used crankcase motor oil. Thereafter the stained samples were washed once using a standard automatic home washing machine and a standard detergent (AATTC Standard Detergent 124). The washing water temperature was 120° F. (49° C.).

Summarized on the following page in Table II are the results obtained from the above-described soil release evaluation.

TABLE II

| Sample No. | Soil Release Agent (%) | Anti-Redeposition Agent (%) | Anti-Redeposition Agent | Results: Mineral Oil | Results: Used Motor Oil |
|---|---|---|---|---|---|
| 1 | .1 | 0.005 | Citric Acid | Good | Good |
| 2 | .1 | 0.05 | Citric Acid | Good | Good |
| 3 | .1 | .2 | Citric Acid | Good | Good |
| 4 | .1 | .5 | Citric Acid | Good | Good |
| 5 | .1 | .15 | Acidic Acrylic Copolymer* | Good | Good |
| 6 | .1 | .1 | Boric Acid | Good | Good |
| 7 | .1 | .5 | Boric Acid | Good | Good |
| 8 | .1 | .1 | Malic Acid | Good | Good |
| 9 | .1 | .5 | Malic Acid | Poor | Poor |
| 10 | .1 | .1 | Polyacrylic Acid | Good | Good |
| 11 | .1 | .5 | Polyacrylic Acid | Good | Good |
| 12 | .1 | .1 | Itaconic Acid | Good | Good |
| 13 | .1 | .5 | Itaconic Acid | Good | Good |
| 14 | .1 | .5 | Tartaric Acid | Poor | Poor |
| 15 | .1 | 0 | | Good | Good |
| 16 | 0 | 0 | | Poor | Poor |

*Copolymer of 30% ethyl acrylate and 70% methacrylic acid.

The above experiments clearly indicate that anti-redeposition properties can be imparted to polyester textile materials without a loss of desired soil release properties by using the proper combination of the cellulose ether soil release agent and the specified anti-redeposition agents of the subject invention.

Therefore, having thus described the invention, I claim:

1. A method for improving the particulate redeposition properties of a polyester textile material while imparting soil release properties to same which comprises:

(a) forming an aqueous admixture consisting essentially of from about 0.0001 to about 10 weight percent of a cellulose ether soil release agent and an effective amount of an anti-redeposition agent selected from the group consisting of citric acid and acidic acrylic copolymers containing from about 10 weight percent to about 90 weight percent of the acid constituent, such being calculated as acrylic acid, said effective amount being that amount to provide a ratio of the anti-redeposition agent to the cellulose ether soil release agent of from about 1.5:1 to about 50:1;

(b) applying said aqueous admixture to the polyester textile material in an amount sufficient to substantially wet the polyester textile material and provide at least about 0.0001 weight percent of said hydroxy ether cellulose soil release agent on the textile material and at least about 0.001 weight percent of said anti-redeposition agent on the textile material;

(c) drying the wetted textile material to remove substantially all the water therefrom; and (d) recovering a resulting treated textile material.

2. The method for improving the particulate redeposition properties of a polyester textile material according to claim 1 wherein the ratio of the anti-redeposition agent to the cellulose ether soil release agent is from about 2:1 to about 5:1.

3. The method for improving the particulate redeposition properties of a polyester textile material according to claim 1 wherein said acidic acrylic copolymer anti-redeposition agent is further defined as a copolymer of ethyl acrylate and methacrylic acid and the ethyl acrylate and methacrylic acid constituents are present in a ratio of 30:70 percent respectively.

4. The method for improving the particulate redeposition properties of polyester textile material according to claim 1 wherein said anti-redeposition agent is citric acid.

5. An aqueous fabric treating composition for improving the soil release properties of a polyester textile material while also improving the particulate anti-redeposition properties of polyester fabrics which consists essentially of water, from about 0.0001 to about 10 weight percent of a cellulose ether soil release agent and an effective amount of a particulate anti-redeposition agent selected from the group consisting of citric acid and acidic acrylic copolymers containing from about 10 weight percent to about 90 weight percent of the acidic constituent, said effective amount being that amount to provide a ratio of the particulate anti-redeposition agent to the cellulose ether soil release agent of from about 1.5:1 to about 50:1.

6. The aqueous fabric treating composition according to claim 5 wherein said cellulose ether soil release agent is selected from the group consisting of methyl cellulose, hydroxy butyl methyl cellulose, hydroxy propyl methyl cellulose and hydroxy propyl cellulose.

7. The aqueous fabric treating composition according to claim 6 wherein the ratio of the anti-redeposition agent to the cellulose ether soil release agent is from about 2:1 to about 5:1.

8. The aqueous fabric treating composition according to claim 7 wherein said acidic acrylic copolymer anti-redeposition agent is further defined as a copolymer of ethyl acrylate and methacrylic acid and the ethyl acrylate and methacrylic acid constituents are present in a ratio of 30:70 percent respectively.

9. The aqueous fabric treating composition according to claim 7 wherein said anti-redeposition agent is citric acid.

* * * * *